US011470894B1

(12) United States Patent
Sankar

(10) Patent No.: US 11,470,894 B1
(45) Date of Patent: Oct. 18, 2022

(54) CONVERTIBLE JACKET

(71) Applicant: Ashley Sankar, Atlanta, GA (US)

(72) Inventor: Ashley Sankar, Atlanta, GA (US)

( * ) Notice: Subject to any disclaimer, the term of this patent is extended or adjusted under 35 U.S.C. 154(b) by 0 days.

(21) Appl. No.: 17/656,628

(22) Filed: Mar. 25, 2022

Related U.S. Application Data

(60) Provisional application No. 63/290,667, filed on Dec. 17, 2021.

(51) Int. Cl.
*A41D 15/04* (2006.01)
*A41D 1/02* (2006.01)

(52) U.S. Cl.
CPC ..... *A41D 15/04* (2013.01); *A41D 1/02* (2013.01)

(58) Field of Classification Search
CPC ..... A41D 15/04; A41D 1/02
USPC ..... 3/96, 95, 108, 94, 79
See application file for complete search history.

(56) References Cited

U.S. PATENT DOCUMENTS 4,476,587 A * 10/1984 Itoi ..... A45F 4/12 2/94
4,483,469 A * 11/1984 Arisland ..... A41D 15/04 224/582
4,637,076 A * 1/1987 Tartt ..... A45F 4/12 2/102
5,794,264 A * 8/1998 Yuen ..... A41D 15/04 2/311
5,815,833 A * 10/1998 Kuo ..... A47G 9/086 5/413 AM
D911,674 S * 3/2021 Wood ..... D2/828
10,973,309 B2 * 4/2021 Thomas ..... A45F 3/04
2005/0198723 A1 * 9/2005 Green ..... A45F 4/12 2/93
2020/0107594 A1 * 4/2020 Kilchoer ..... A45C 13/02
2020/0138127 A1 * 5/2020 Nolte ..... A41D 15/04
2022/0160063 A1 * 5/2022 Li ..... A41D 15/002

* cited by examiner

*Primary Examiner* — Gloria M Hale
(74) *Attorney, Agent, or Firm* — Johnfar Kerlee

(57) ABSTRACT

Disclosed are embodiments of a jacket that can be converted into, for example, a tote bag. The convertible jacket can include zippers placed at the midriff and waist for converting the jacket into a tote bag. In some embodiments, the handles of the tote bag are placed inside of the convertible jacket for carrying the tote bag after the convertible jacket is converted into the tote bag. In certain embodiments, the tote bag portion can be unzipped from the convertible jacket, then the jacket can be worn as a cropped jacket or the top portion of the convertible jacket can be placed into the tote bag. In one embodiment, the convertible jacket can include a zipper at the hem to form the bottom of the tote bag, and can include another zipper at the middle of the jacket for facilitating detachment of the bottom portion from the convertible jacket.

15 Claims, 3 Drawing Sheets

CONVERTIBLE JACKET

FIELD OF THE INVENTION

The present invention relates to convertible garments. More particularly, the invention relates to jackets that are convertible into a tote.

BACKGROUND OF THE INVENTION

Jackets that are convertible to a utilitarian article (for example, totes, back-packs, or duffel bags) have proven to be generally unsatisfactory and unworkable in practice. Such jackets are typically characterized by elaborate arrangements of buckles, snaps, complicated folding procedures, and other cumbersome procedures and devices which must be manipulated in order to convert the jacket the utilitarian article or vice versa. Furthermore, convertible jackets tend to be bulky, aesthetically unpleasing, and do not lend themselves to use as stylish or fashionable garments. Such jackets are typically poncho-type or loose-fitting garments which carry a large pouch and a plurality of fasteners that are plainly visible when the garment is worn as a jacket. These implements do not create an aesthetically pleasing or fashionable garment.

Therefore, what is needed in the art is a jacket that can be simply and easily converted into, for example, a carry or tote. The present application provides these and other advantages as will be apparent from the following detailed description and accompanying figures.

SUMMARY OF THE INVENTION

This summary is provided to introduce a selection of concepts in a simplified format that are further described in the detailed description of the present disclosure. This summary is not intended to identify key or essential inventive concepts of the present disclosure, nor is it intended for determining the scope of the present disclosure.

An aspect of the present invention discloses a jacket that can be converted, at least in part, into a bag (tote bag or tote). The jacket can be, for example, a windcheater/windbreaker jacket. In one embodiment, a jacket includes zippers that exist at the midriff and waist for converting at least part of the jacket into a tote. In some embodiments, handles can be placed in an inner liner of the jacket, and the handles can be configured for carrying the tote after the tote portion of the jacket is converted to a tote.

According to an embodiment, a tote portion is configured to be unzipped from a crop top portion of the convertible jacket; the crop to portion can then be worn as a cropped jacket or it can be stored in the tote.

According to some embodiments, the convertible jacket can include a zipper at the bottom hem of the jacket to facilitate forming the bottom of the tote, and another zipper is placed near the middle of the jacket (near the breastbone).

According to certain embodiments, a drawstring can be placed at the bottom hem of the jacket for cinching the jacket to, for example, prevent water or debris from getting inside.

According to one embodiment, the handles for the tote can be placed within the inner lining of the jacket, and these handles can be secured by, for example, a hook-and-loop fastener to prevent the handles from moving around and obstructing functionality and/or wearability of the jacket.

Additional Content to be Added Here After Finalizing the Claims.

To further clarify the advantages and features of the present disclosure, a more particular description of the disclosure will be rendered by reference to specific embodiments thereof, which is illustrated in the appended drawings. It is appreciated that these drawings depict only typical embodiments of the disclosure and are therefore not to be considered limiting of its scope. The disclosure will be described and explained with additional specificity and detail with the accompanying drawings.

BRIEF DESCRIPTION OF THE DRAWINGS

The subject matter that is regarded as the invention is particularly pointed out and distinctly claimed in the claims at the conclusion of the specification. The foregoing and other aspects, features, and advantages of the invention are apparent from the following detailed description taken in conjunction with the accompanying drawings in which:

Figure 1A:
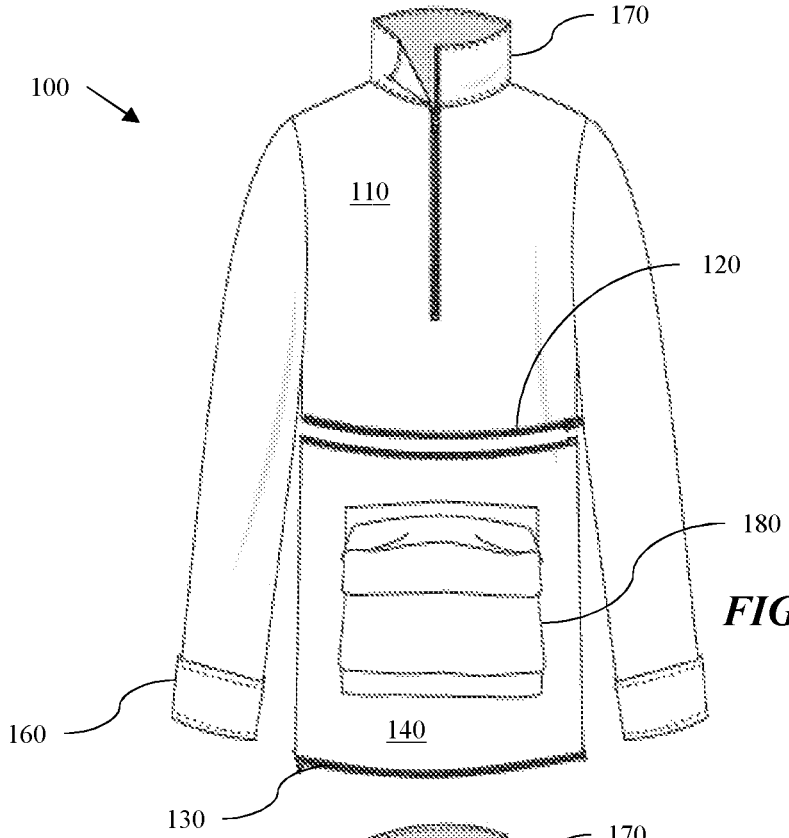
FIG. 1A is a plan front view of a convertible jacket in accordance with an embodiment of the invention.

Further, skilled artisans will appreciate that elements in the drawings are illustrated for simplicity and may not have necessarily been drawn to scale. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having the benefit of the description herein.

DETAILED DESCRIPTION OF THE INVENTION

For the purpose of promoting an understanding of the principles of the invention, reference will now be made to the embodiment illustrated in the drawings, and specific language will be used to describe the same. It will nevertheless be understood that no limitation of the scope of the invention is thereby intended. Such alterations and further modifications in the illustrated system, and such further applications of the principles of the invention as illustrated therein would be contemplated as would normally occur to one skilled in the art to which the invention relates. Unless otherwise defined, all technical and scientific terms used herein have the same meaning as commonly understood by one of ordinary skilled in the art. The system, methods, and examples provided herein are illustrative only and are not intended to be limiting.

The term "some" as used herein is to be understood as "none or one or more than one or all." Accordingly, the terms "none," "one," "more than one," "more than one, but not all" or "all" would all fall under the definition of "some." The term "some embodiments" may refer to no embodiments or to one embodiment or to several embodiments or to all embodiments, without departing from the scope of the present disclosure.

The terminology and structure employed herein is for describing, teaching, and illuminating some embodiments and their specific features. It does not in any way limit, restrict or reduce the spirit and scope of the claims or their equivalents.

More specifically, any terms used herein such as but not limited to "includes," "comprises," "has," "consists," and grammatical variants thereof do not specify an exact limitation or restriction and certainly do not exclude the possible addition of one or more features or elements, unless otherwise stated, and furthermore must not be taken to exclude the possible removal of one or more of the listed features and elements, unless otherwise stated with the limiting language "must comprise" or "needs to include."

Whether or not a certain feature or element was limited to being used only once, either way, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language such as "there needs to be one or more . . . " or "one or more element is required."

Unless otherwise defined, all terms, and especially any technical and/or scientific terms, used herein may be taken to have the same meaning as commonly understood by one having ordinary skills in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility and non-obviousness.

Use of the phrases and/or terms including, but not limited to, "a first embodiment," "a further embodiment," "an alternate embodiment," "one embodiment," "an embodiment," "multiple embodiments," "some embodiments," "other embodiments," "further embodiment", "furthermore embodiment", "additional embodiment" or variants thereof do not necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or alternatively in the context of more than one embodiment, or further alternatively in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should not be necessarily taken as limiting factors to the attached claims. The attached claims and their legal equivalents can be realized in the context of embodiments other than the ones used as illustrative examples in the description below.

Embodiments of the present invention will be described below in detail with reference to the accompanying drawings.

In one embodiment, a jacket can be configured to facilitate converting the jacket into a bag. The jacket can be, for example, a windcheater/windbreaker jacket. The jacket can include zippers at the midriff and waist. In some embodiments, the jacket includes handles for the bag, and the handles are located inside the jacket. The jacket can include a bag portion that can be unzipped and removed from an upper portion of the convertible jacket, which upper portion can (a) be worn as a cropped jacket or (b) placed into the bag. In certain embodiments, the convertible jacket can include a zipper at the hem to form the bottom of the bag. In one embodiment, the convertible jacket can include a zipper placed at the middle of the jacket near the breastbone.

In an embodiment, the disclosed convertible jacket can be used in the following ways: i) a waterproof, rain-repelling jacket, ii) a cropped waterproof, rain-repelling jacket, and iii) a tote. In some embodiments, inside the bottom part of the jacket, handles are hidden inside of the jacket lining. To convert the convertible jacket into a tote, the handles can be unveiled and used. When desired, these handles can be lifted from the lining area and used to carry the tote.

In an embodiment, the disclosed convertible jacket serves as a multi-functioning clothing item that provides protection from the wind, rain, and/or a chilly breeze while providing a tote to carry, for example, groceries, shopping purchases, gym equipment, and the like. In some embodiments, the convertible jacket can be made of a waterproof material (such as nylon) to make the jacket waterproof. However, this jacket can be made of any suitable material.

In an embodiment, the convertible jacket includes a top portion with a zipper and a bottom portion at the end configured to facilitate unzipping and carrying the bottom half of the jacket as a tote. The zippers can be, for example, heavy-duty metal zippers to ensure that materials placed inside tote are secure and to prevent the contents from falling out of the bottom or top when placed inside the tote. Although zippers are used in some of the embodiments described here, equivalent means of fastening the top portion to the bottom portion can be used (such means can include, for example, hook-and-loop materials, buttons, laces, and the like).

In an embodiment, when the convertible jacket is fully assembled, the convertible jacket can include a zipper at the end of the convertible jacket, the zipper can be hidden away in a hem of the convertible jacket, and the zipper can serve to close a base of the tote. The top zipper can be located in the middle of the jacket which allows the jacket to be used in two different ways: i) zip off the bottom portion and place the top of the jacket inside the tote, or ii) zip off the bottom portion and use as a tote and wear the top portion of jacket as a cropped jacket.

Figure 1B:
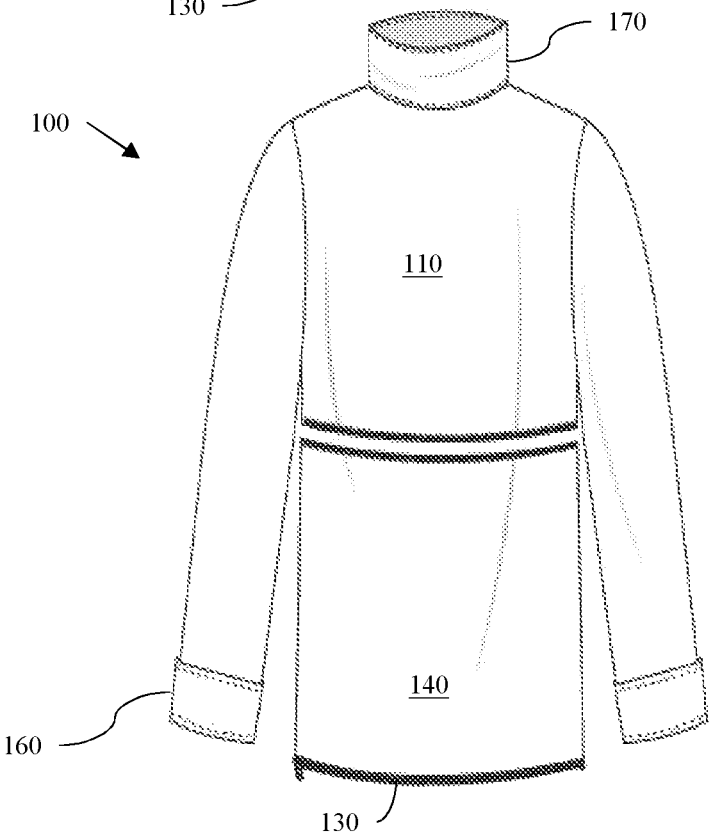
FIG. 1B is a plan back view of the convertible jacket of FIG. 1A.

Referencing FIG. 1A and FIG. 1B, in one embodiment, convertible jacket 100 can include crop top portion 110 coupled with zipper 120 to tote portion 140. Tote portion 140 can include part of zipper 130. In some embodiments, convertible jacket 100 can include cuffs 160 and collar 170 attached to crop portion 110. Band collar 170 can be configured to facilitate covering the neck of a person wearing convertible jacket 100. Zipper 120 can be placed at, near, or in the vicinity of, the breastbone of convertible jacket 100, and zipper 120 can be configured to facilitate detaching crop top portion 110 from tote portion 140. Zipper 130 can be placed at a bottom hem of convertible jacket 100 to form the bottom of tote portion 140, and zipper 130 can be configured to facilitate securing any materials placed inside tote 140.

Figure 2:
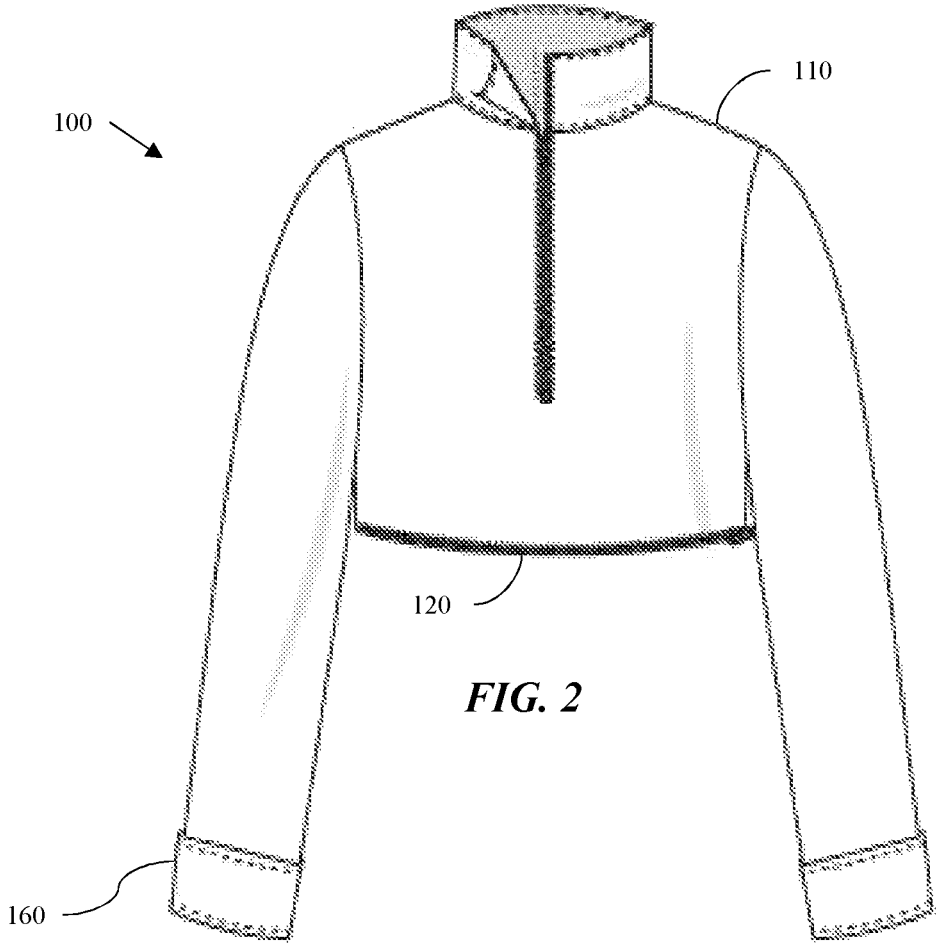
FIG. 2 is a plan front view of a crop jacket portion of the convertible jacket of FIG. 1A.

Referencing FIG. 2, in one embodiment, crop top portion 110 can include part of zipper 120, cuffs 160, and collar 170.

Figure 3:
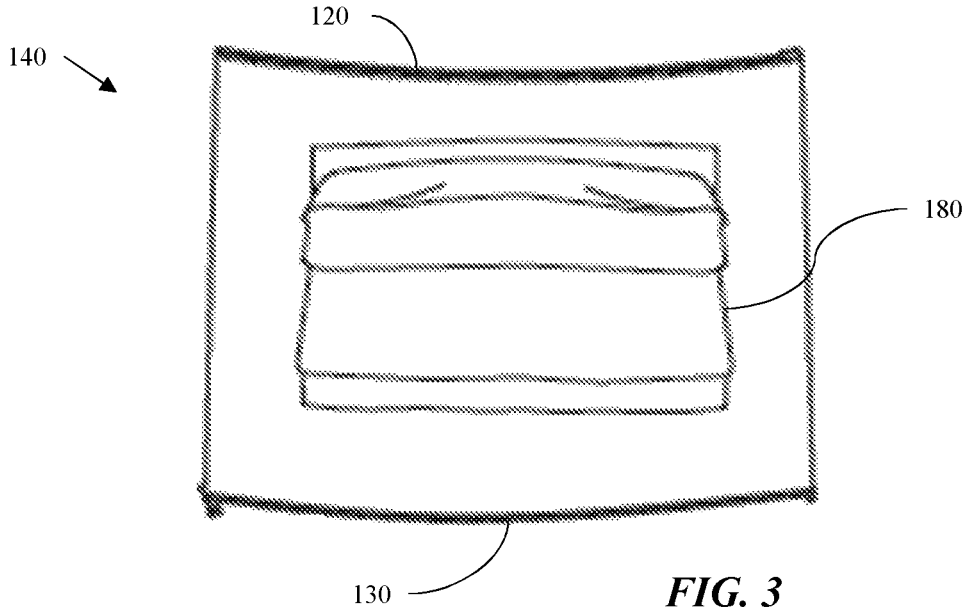
FIG. 3 is a plan front view of a tote portion of the convertible jacket of FIG. 1A.

Referencing FIG. 3, in one embodiment, tote portion 140 can include pocket 180, zipper 130, and a portion of zipper 120.

Figure 4A:
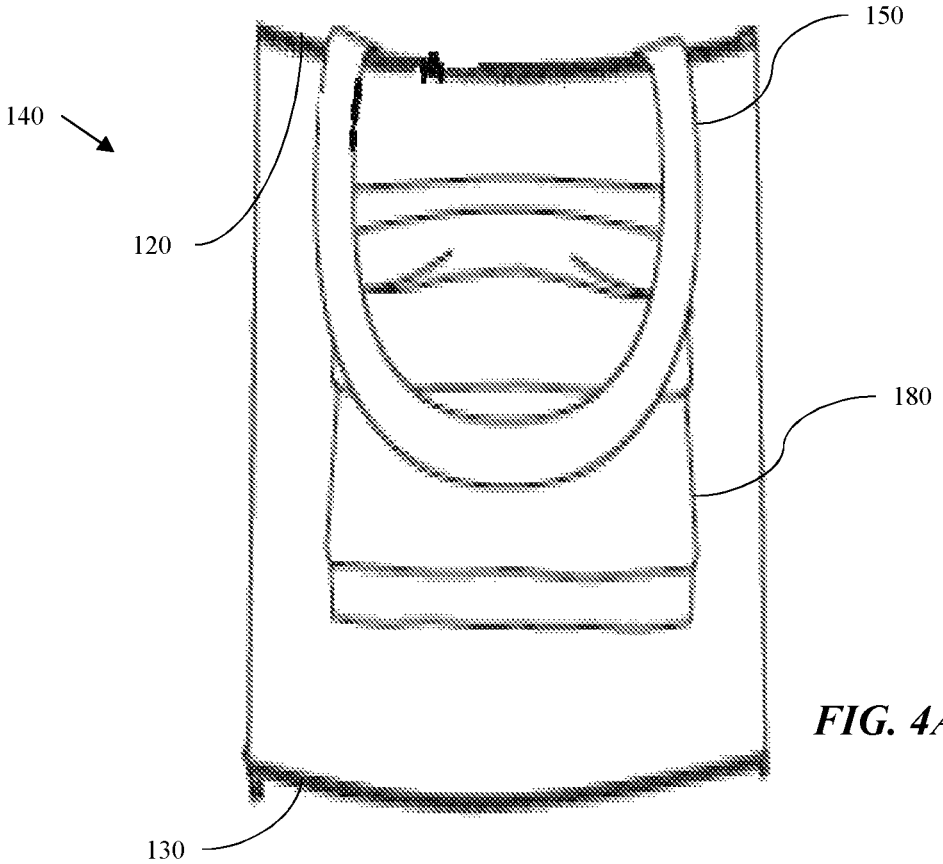
FIG. 4A is a plan front view of a tote associated with the convertible jacket of FIG. 1A.
Figure 4B:
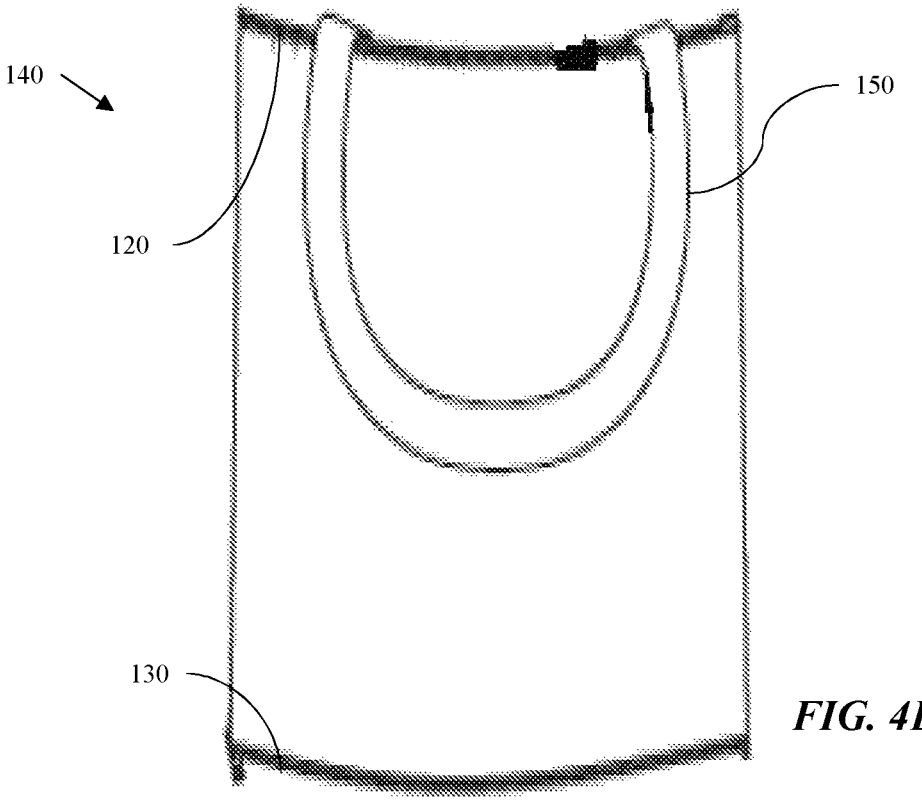
FIG. 4B is a plan back view of the tote of FIG. 4A.

Referencing FIG. 4, in one embodiment, tote portion 140 can include pocket 180, part of zipper 120, zipper 130, and handles 150. In some embodiments, handles 150 are placed inside (or attached to) an inner liner of convertible jacket 100 and are configured to facilitate carrying tote portion 140.

Convertible jacket 100 can be made of any suitable materials including cotton, leather, synthetic leather, nylon, fleece, synthetic materials, polyester, rayon, spandex, lace, and the like.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of the embodiments is by no means limited by these specific examples. Numerous variations, whether explicitly given in the specification or not, such as differences in structure, dimension, and use of material, are possible.

The invention claimed is:

1. A convertible jacket and tote combination comprising:

a crop top portion;

a tote portion removably coupled to the crop portion;

a first zipper placed at a middle of the jacket, near a breastbone of a user of the convertible jacket, wherein the first zipper is configured to facilitate coupling and/or uncoupling the crop top portion from the tote portion;

a bottom hem configured to be used as the bottom of the tote, the bottom hem placed substantially along a bottom of the tote portion; and a second zipper coupled to the bottom hem along the bottom hem.

2. The convertible jacket of claim 1, further comprising a band collar configured for covering a neck of a user of the convertible jacket.

3. The convertible jacket of claim 1, further comprising handles placed within an inner lining of the tote portion, wherein the handles are configured to be used as handles for the tote portion.

4. A method of using a convertible jacket, the method comprising:

providing a jacket having a crop top portion and a tote portion, wherein the tote portion is configured to be used as a tote;

wherein the tote portion comprises a bottom hem and a first zipper coupled to the bottom hem substantially along a bottom of the bottom hem;

detaching the crop top portion from the tote portion; and using the tote portion as a tote.

5. The method of claim 4, further comprising using the crop top portion as a cropped jacket.

6. The method of claim 4, further comprising storing the crop top portion in the tote portion.

7. The method of claim 4, wherein providing a crop top portion and a tote portion further comprises providing a second zipper configured to facilitate zipping and/or unzipping the crop top portion from the tote portion.

8. The method of claim 4, wherein providing a crop top portion and a tote portion further comprises providing handles within an inner lining of the convertible jacket configured to facilitate carrying the tote.

9. A jacket comprising:

a crop top portion;

a tote portion, the tote portion comprising a bottom hem;

a first zipper coupling the crop top portion to the tote portion; and a second zipper coupled to the bottom hem substantially along the bottom hem, the second zipper configured to close a bottom of the tote portion to facilitate converting the tote portion into a carrying tote.

10. The jacket of claim 9, wherein the crop portion is configured to be worn as a crop top jacket after the crop top portion is unzipped from the tote portion.

11. The jacket of claim 9, wherein the tote portion comprises an external pocket.

12. The jacket of claim 9, wherein the tote portion comprises handles, wherein the handles are placed in an inner lining of the tote portion, and wherein the handles are configured to facilitate carrying the tote.

13. The jacket of claim 9, wherein the first zipper is placed at a middle of the jacket in the vicinity of a breastbone of a user of the jacket.

14. The jacket of claim 9, wherein the crop top portion is configured to be used as a crop top jacket when unzipped from the tote portion.

15. The jacket of claim 9, wherein the tote portion comprises handles, wherein the handles are attached to an inner lining of the tote portion.

* * * * *